US007325350B1

(12) United States Patent
Grimes

(10) Patent No.: US 7,325,350 B1
(45) Date of Patent: Feb. 5, 2008

(54) FIREARM FOR EXTINGUISHING A FIRE FROM A POSITION REMOTE FROM THE FIRE

(76) Inventor: Paul J. Grimes, 30 Stewart Ave., Huntington, NY (US) 11743

( * ) Notice: Subject to any disclaimer, the term of this patent is extended or adjusted under 35 U.S.C. 154(b) by 245 days.

(21) Appl. No.: 11/302,689

(22) Filed: Dec. 14, 2005

Related U.S. Application Data

(63) Continuation-in-part of application No. 10/962,227, filed on Oct. 8, 2004, now abandoned.

(51) Int. Cl.
*F41C 9/00* (2006.01)
*A62C 13/00* (2006.01)
*F42B 12/36* (2006.01)

(52) U.S. Cl. ..... 42/1.08; 42/106; 169/84; 169/36; 102/370

(58) Field of Classification Search ..... 42/1.08, 42/106; 169/30, 36, 84; 102/370
See application file for complete search history.

(56) References Cited

U.S. PATENT DOCUMENTS

| | | | | | |
|---|---|---|---|---|---|
| 13,660 | A | * | 10/1855 | Storm | 42/61 |
| 993,023 | A | * | 5/1911 | Burgsmueller | 102/370 |
| 1,500,431 | A | * | 7/1924 | Wolf | 42/51 |
| 1,580,816 | A | * | 4/1926 | Dunn | 169/36 |
| 1,784,243 | A | * | 12/1930 | Moffet | 102/370 |
| 1,861,533 | A | * | 6/1932 | Hutchinson | 42/51 |
| 1,989,097 | A | * | 1/1935 | Jones | 169/30 |
| 2,028,217 | A | * | 1/1936 | Huffman | 102/370 |
| 2,838,122 | A | * | 6/1958 | Hutchinson | 169/84 |
| 3,352,238 | A | * | 11/1967 | Spragg et al. | 102/370 |
| 3,431,853 | A | * | 3/1969 | Allen et al. | 102/370 |
| 3,791,303 | A | * | 2/1974 | Sweeney et al. | 102/502 |
| 3,980,139 | A | | 9/1976 | Kirk | |
| 4,285,403 | A | | 8/1981 | Poland | |
| 5,035,183 | A | * | 7/1991 | Luxton | 102/502 |
| 5,183,117 | A | | 2/1993 | Strickland | |
| 5,441,114 | A | | 8/1995 | Spector et al. | |
| 5,492,179 | A | | 2/1996 | Spector et al. | |
| 5,676,190 | A | | 10/1997 | Matsumoto et al. | |
| 5,778,984 | A | | 7/1998 | Suwa | |
| 6,364,026 | B1 | | 4/2002 | Doshay | |
| 6,543,547 | B2 | | 4/2003 | Neumeir et al. | |
| 6,732,725 | B2 | | 5/2004 | Doud | |
| 6,772,694 | B1 | * | 8/2004 | Pearce et al. | 102/502 |
| 2003/0010185 | A1 | | 1/2003 | O'Dwyer | |
| 2003/0226554 | A1 | | 12/2003 | Dowers et al. | |
| 2004/0069505 | A1 | | 4/2004 | Griffin | |

* cited by examiner

*Primary Examiner*—Bret Hayes
(74) *Attorney, Agent, or Firm*—Richard L. Miller

(57) ABSTRACT

A firearm for extinguishing a fire from a position remote from the fire. A cartridge is disposed in, and is selectively discharged from, a pistol. The cartridge includes a head containing a pressurized fire extinguishant and a casing containing a propellent. The casing is removably attached to the head by mating portions of hook and loop fasteners so as to allow the casing and the head to be independent of each other prior to use. The bead has a lip containing a chamber communicating with the pressurized fire extinguishant therein and which exits through through bores in both sides of the lip, respectively. A release pin is removed from the through bores and the firing apparatus is activated causing the cartridge to exit the barrel and expel the pressurized fire extinguishant through the through bores on its way to the fire during use.

27 Claims, 1 Drawing Sheet

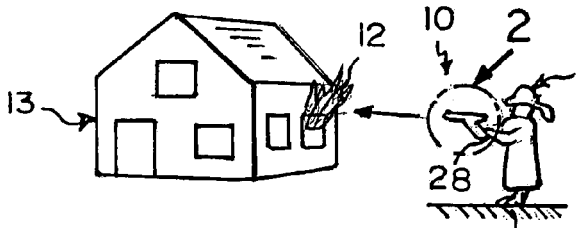
Fig. 1
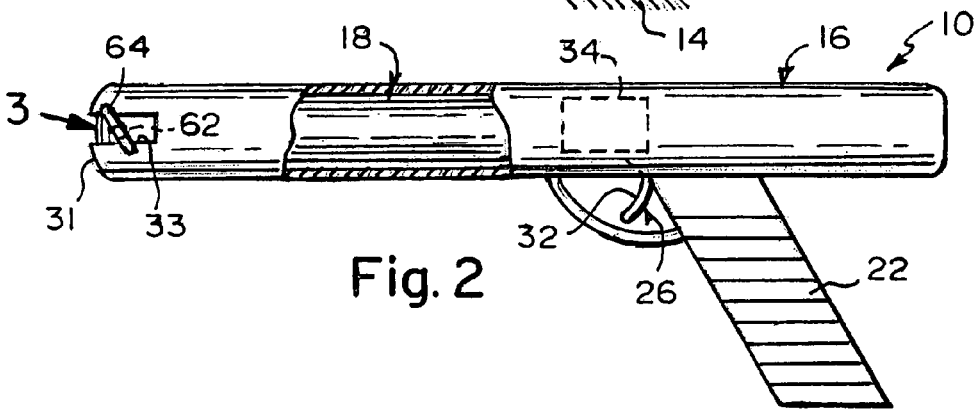
Fig. 2
Fig. 3
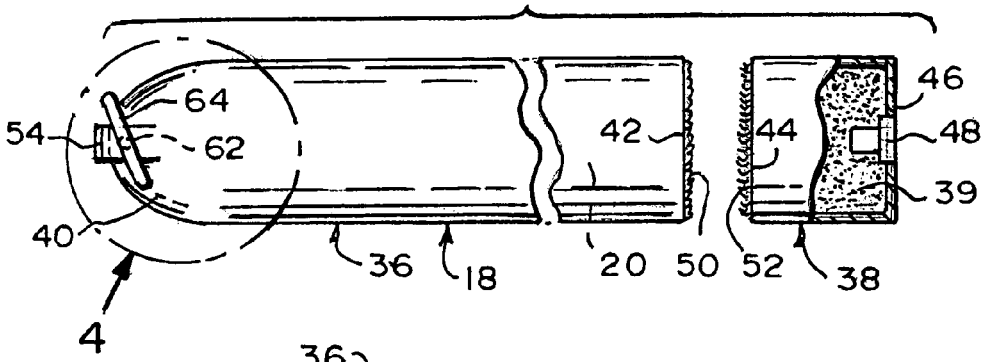
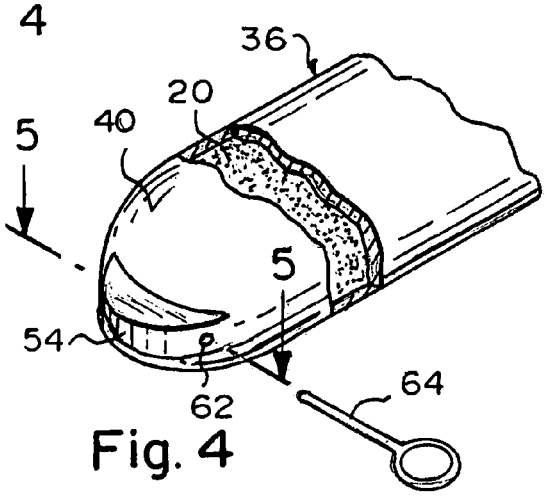
Fig. 4
Fig. 5
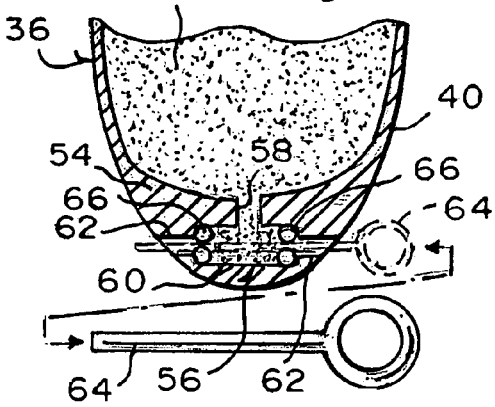

FIREARM FOR EXTINGUISHING A FIRE FROM A POSITION REMOTE FROM THE FIRE

CROSS REFERENCE

The present Application is a Continuation-In-Part Application of Ser. No.: 10/962,227, Filed on, Oct. 8, 2004 now abandoned, titled: FIREARM FOR EXTINGUISHING A FIRE FROM A POSITION REMOTE FROM THE FIRE, of Group Art Unit 3641, which is presently copending and for which there has been maintained a continuous chain of copendency.

BACKGROUND OF THE INVENTION

1. Field of the Invention

The present invention relates to a device for extinguishing a fire, and more particularly, the present invention relates to a firearm for extinguishing a fire from a position remote from the fire.

2. Description of the Prior Art

Numerous innovations for remote fire extinguishers have been provided in the prior art that will be described. Even though these innovations may be suitable for the specific individual purposes to which they address, however, they differ from the present invention.

A FIRST EXAMPLE, U.S. Pat. No. 3,980,139 to Kirk teaches a bomb containing an explosive and a fire extinguishing chemical so that the bomb can be exploded within a fire and extinguish the fire flames; the bomb including a glass cylinder that can be readily fragmented so to disperse its chemical content into all directions and the glass cylinder having extending fins so to absorb a rising temperature such as from a vicinity fire, the fins transferring the heat to an explosive charge for automatic operation.

A SECOND EXAMPLE, U.S. Pat. No. 4,285,403 to Poland teaches a waterproofed explosive charge that is suspended within a frangible, spherical shell containing an aqueous solution. The assembly is dropped from an airplane or helicopter towards a fire below. Either a shock-actuated percussion cap or a fuse-ignited detonation cap activates the explosive charge at the appropriate moment and the resultant explosion creates a vapor-like fog. A portion of the combustion-supporting oxygen is displaced by the fog droplets. The minute water droplets also absorb heat energy, thereby lowering surrounding air and fuel temperatures. These effects, coupled with the concussive shock wave, act to snuff the fire.

A THIRD EXAMPLE, U.S. Pat. No. 5,441,114 to Spector, et al. teaches a system for extinguishing a fire that includes a conventional fire extinguishing cylinder for releasing a pressurized fire extinguishing gas, and a device including a composition which includes a first reactant and a second reactant. The composition is activated so as to cause the first reactant and the second reactant to react with each other to create solid particulate products having a diameter of about one micron or less which are effective in extinguishing fires. The device is located so that the fire extinguishing gas and the particulate products intermix.

A FOURTH EXAMPLE, U.S. Pat. No. 5,492,179 to Spector, et al. teaches a system for extinguishing a first in a volume that includes a first extinguishing device for delivery from a distance into communication with the volume, the device including a composition which includes a first reactant and a second reactant. The composition is activated so as to cause the first reactant and the second reactant to react with each other to create solid particulate products having a diameter of about one micron or less which are effective in extinguishing fires. The device includes a convoluted path defined by a plurality of metal protrusions through which the products are made to travel, the path serving as a flame arrestor.

A FIFTH EXAMPLE, U.S. Pat. No. 5,778,984 to Suwa teaches a fluid fire extinguishing agent shell for throwing, comprising a fluid fire extinguishing agent sealed in a thin-walled resin container having such a size that one can throw, which is breakable by a shock, said fluid fire extinguishing agent being a mixture comprising from about 47% to approximately the saturation point of ammonium chloride, from about 4% to about 8% of sodium bicarbonate, from about 25% to about 35% of potassium carbonate, from about 8% to about 14% of ammonium secondary phosphate, and from about 2% to about 6% of sodium tungstate all in terms of by weight, dissolved in a suitable amount of water, is a simple fire extinguishing appliance that anyone can easily use at the time of occurrence of a fire and which is effective even after the storage for a long period of time.

A SIXTH EXAMPLE, U.S. Pat. No. 6,364,026 to Doshay teaches a fire fighting system comprising a set of unmanned, aircraft, fire detection subsystems; a set of launch-on-need, unmanned aircraft, fire suppression subsystems; and a manned, central, robotic vehicle flight control and monitoring station. When deployed, the robotic survey vehicles continuously patrol the wildland so that fires can be detected when they first start. The robotic extinguisher vehicles, which contain fire suppressant or extinguisher are deployed on rocket assist or other automated take-off launchers at critical locations throughout the wildland. The pilot at the central monitoring station controls the flight path of the survey vehicles and continuously receives video and fire scan information from them. Upon detection of a fire signal, its position is determined via use of a Global Positioning Satellite (GPS) system and permission is sought from the applicable security agency to launch an extinguisher vehicle. When permission is granted, the pilot at the central monitoring station provides the fire co-ordinates to the nearest, available extinguisher vehicle and initiates its launch. This vehicle files to the location, performing rough homing with its onboard infrared (IR) sensor and final targeting via video camera and assistance from the GPS data, drops its fire suppressant on the first, circles the fire to assess drop results and heads to a pre-established landing strip. At the landing strip, the extinguisher vehicle is checked out, re-loaded with another extinguisher payload and another launch assist device and again deployed in the wildland.

A SEVENTH EXAMPLE, U.S. patent application Ser. No. 2003/0010185 to O'Dwyer teaches a method of target specific fire fighting including the steps of providing a barrel assembly (10, 31), suitably in a pod (33), which is capable of firing a plurality of cartridges (11). Each cartridge having containment (21) for matter or objects to be delivered to a target fire; loading the containments with matter or objects comprising fire reatardants, dousing or extinguishing means; providing control means (37) for aiming and controlling the rate of fire of cartridges and/or quantity of the cartridges fired; and firing (34) the cartridges in a controlled manner from a remote location toward the fire so as to douse the fire. The barrel assemblies (31) of the cartridge launching apparatus (33) are of the type having a plurality cartridges (11) arranged in-line within a barrel (12) and associated with discrete selectively ignitable propellant charges (13) for propelling the cartridges sequentially through the muzzle of the barrel (12).

It is apparent that numerous innovations for fire extinguishers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a firearm for extinguishing a fire from a position remote from the fire that avoids the disadvantages of the prior art.

ANOTHER OBJECT of the present invention is to provide a firearm for extinguishing a fire from a position remote from the fire that is simple to use.

BRIEFLY STATED, STILL ANOTHER OBJECT of the present invention is to provide a firearm for extinguishing a fire from a position remote from the fire. A cartridge is disposed in, and is selectively discharged from, a pistol. The cartridge includes a head containing a pressurized fire extinguishant and a casing containing a propellent. The casing is removably attached to the head by mating portions of hook and loop fasteners so as to allow the casing and the head to be independent of each other prior to use. The head has a lip containing a chamber communicating with the pressurized fire extinguishant therein and which exits through through bores in both sides of the lip, respectively. A release pin is removed from the through bores and the firing apparatus is activated causing the cartridge to exit the barrel and expel the pressurized fire extinguishant through the through bores on its way to the fire during use.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention in use;

FIG. 2 is an enlarged diagrammatic side elevational view, with parts broken away and in section, of the area generally enclosed by the dotted curve identified by ARROW 2 in FIG. 1 of the present invention;

FIG. 3 is an enlarged diagrammatic side elevational view, with parts broken away and in section, of the cartridge of the present invention identified by ARROW 3 in FIG. 2;

FIG. 4 is a diagrammatic perspective view, with parts broken away and in section, of the area generally enclosed by the dotted curve identified by ARROW 4 in FIG. 3 of the head of the cartridge of the present invention; and FIG. 5 is an enlarged diagrammatic cross sectional view taken along LINE 5-5 in FIG. 4.

LIST OF REFERENCE NUMERALS UTILIZED IN THE DRAWING

10 firearm of present invention for extinguishing fire 12 from position 14 remote from fire 12
12 fire
13 burning building, house, ship etc.
14 position remote from fire 12
16 pistol
18 cartridge
20 pressurized fire extinguishant
22 handle of pistol 16 for fitting in hand 28 of user 30
24 barrel of pistol 16
26 firing apparatus of pistol 16
28 hand of user 30
30 user
31 muzzle end of barrel 24 of pistol 16
32 trigger of firing apparatus 26 of pistol 16 for being readily accessible by trigger finger (not shown) of hand 28 of user 30 when hand 28 of user 30 grips handle 22
33 through slot in one side wall of muzzle end 31 of barrel 24 of pistol 16
34 firing pin of firing apparatus 26 of pistol 16
36 head of cartridge 18
38 casing of cartridge 18
39 propellent
40 front end of head 36 of cartridge 18
42 rear end of head 36 of cartridge 18
44 front end of casing 38 of cartridge 18
46 rear end of casing 38 of cartridge 18
48 primer cap on rear end 46 of casing 38 of cartridge 18
50 one portion of mating portions of hook and loop fasteners 50, 52
52 other portion of mating portions of hook and loop fasteners 50, 52
54 lip of head 36 of cartridge 18
56 chamber contained in lip 54 of head 36 of cartridge 18
58 longitudinal portion of chamber 56 contained in lip 54 of head 36 of cartridge 18
60 transverse portion of chamber 56 contained in lip 54 of head 36 of cartridge 18
62 through bores in both sides of lip 54 of head 36 of cartridge 18, respectively
64 release pin of head 36 of cartridge 18
66 pair of O-rings of head 36 of cartridge 18

DETAILED DESCRIPTION OF THE PREFERRED EMBODIMENT

Referring now to the figures, in which like numerals indicate like parts, and particularly to FIG. 1, the firearm of the present invention is shown generally at 10 for extinguishing a fire 12, such as in a burning building, house, ship etc. 13, from a position 14 remote from the fire 12.

The general configuration of the firearm 10 can best be seen in FIG. 2, and as such, will be discussed with reference thereto.

The firearm 10 comprises a pistol 16 and a cartridge 18. The cartridge 18 contains a pressurized fire extinguishant 20 and is disposed in the pistol 16 and is selectively discharged therefrom. The pressurized fire extinguishant 20 exits the cartridge 18 as the cartridge 18 exits the pistol 16 and travels towards the fire 12.

The specific configuration of the pistol 16 can best be seen in FIG. 2, and as such, will be discussed with reference thereto.

The pistol 16 comprises a handle 22, a barrel 24, and firing apparatus 26. The barrel 24 extends from the handle 22 and the firing apparatus 26 is operatively connected to the barrel 24.

The handle 22 is shaped for fitting in the hand 28 of a user 30 (FIG. 1). The barrel 24 is hollow so as to be able to contain the cartridge 18 and extends forwardly from the handle 22.

The barrel 22 has a muzzle end 31. One side wall of the muzzle end 31 of the barrel 22 has a through slot 33.

The firing apparatus 26 comprises a trigger 32 and a firing pin 34. The trigger 32 of the firing apparatus 28 depends from where the barrel 24 meets the handle 22 for being readily accessible by the trigger finger (not shown) of the hand 28 of the user 30 when the hand 28 of the user 30 grips the handle 22.

The firing pin 34 of the firing apparatus 26 is operatively connected to the trigger 32 of the firing apparatus 26 and is contained in the barrel 24 so as to engage the cartridge 18 when the trigger 32 of the firing apparatus 26 is squeezed.

The specific configuration of the cartridge 18 can best be seen in FIGS. 3-5, and as such, will be discussed with reference thereto.

The cartridge 18 comprises a head 36 and a casing 38. The casing 38 extends colinearly rearwardly from the head 36.

The head 36 contains the pressurized fire extinguishant 20 and the casing 38 contains a propellant 39.

The head 36 is slender, elongated, generally cylindrically-shaped, and has a front end 40 and a rear end 42.

The front end 40 of the head 36 is generally hemispherically-shaped and the rear end 42 of the head 36 is generally flat.

The casing 38 is slender and generally cylindrically-shaped, and has a front end 44 and a rear end 46.

The front end 44 of the casing 38 is generally flat and the rear end 46 of the casing 38 is generally flat.

The rear end 46 of the casing 38 has a primer cap 48 thereon and the front end 44 of the casing 38 is removably attached to the rear end 42 of the head 36 by mating portions of hook and loop fasteners 50, 52 so as to allow the casing 38 and the head 36 to be independent of each other prior to use.

The head 36 has a lip 54. The lip of the head 36 extends forwardly from the front end 40 of the head 36.

The lip 54 of the head 36 contains a chamber 56. The chamber 56 in the lip 54 of the head 36 is generally T-shaped and has a longitudinal portion 58 and a transverse portion 60.

The longitudinal portion 58 of the chamber 56 in the lip 54 of the head 36 communicates with the pressurized fire extinguishant 20 in the head 36 and the transverse portion 60 of the chamber 56 in the lip 54 of the head 36 communicates with the longitudinal portion 58 of the chamber 56 in the lip 54 of the head 36 and exits through through bores 62 in both sides of the lip 54 of the head 36, respectively.

The head 36 further comprises a release pin 64. The release pin 64 extends releasably through the through bores 62 in the lip 54 of the head 36 and releasably through the transverse portion 60 of the chamber 56 in the lip 54 of the head 36 to prevent the pressurized fire extinguishant 20 from escaping therefrom prior to use.

The through slot 33 in the one side wall of the muzzle end 31 of the barrel 22 provides clearance for the release pin 64 when the cartridge 18 is loaded into the barrel 22 through the muzzle end 31 of the barrel 22.

The head 36 further comprises a pair of O-rings 66. The pair of O-rings 66 are disposed in the through bores 62 in the lip 54 of the head 36, respectively, and provide a seal for the release pin 64.

During use, the release pin 64 is removed and the firing apparatus 26 is activated causing the cartridge 18 to exit the barrel 22 and expel the pressurized fire extinguishant 20 on its way to the fire 12.

This is accomplished because the cartridge 18 is fabricated with the fire-extinguishant 20, such as water, carbon dioxide, gas, chemical foam or other known substances loaded into the cartridge and pre-pressurized at the time of manufacture. Naturally the removal of the pin 64 causes the fire-extinguishant 20 to escape from the cartridge 18 because the fire-extinguishant 20 is already under pressure by virtue of the fact that it was so pre-pressurized at the time it was fabricated and originally sealed closed by the manufacture of the cartridge 18.

It is already well known how to fabricate pressurized cartridge containing fire-extinguishant substances sealed in under pressure. Some typical examples of containers and cartridge that are pre-pressurized may be seen in U.S. Pat. Nos. 4,815,541 to Arrington, 5,676,190 to Matsumoto and 6,742,599 to Nam.

It will be understood that each of the elements described above, or two or more together, may also find a useful application in other types of constructions differing from the types described above.

While the invention has been illustrated and described as embodied in a firearm for extinguishing a fire from a position remote from the fire, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A firearm for extinguishing a fire from a position remote from the fire, comprising:

a) a pistol; and c) a cartridge;

wherein said cartridge contains a pressurized fire extinguishant;

wherein said cartridge is disposed in said pistol;

wherein said cartridge is selectively discharged from said pistol; and wherein said pressurized fire extinguishant exits said cartridge as said cartridge exits said pistol and travels towards the fire;

wherein said pistol comprises a handle;

wherein said pistol comprises a barrel;

wherein said pistol comprises firing apparatus;

wherein said barrel has a muzzle end;

wherein one side wall of said muzzle end of said barrel has a through slot;

wherein said cartridge comprises a head;

wherein said cartridge comprises a casing;

wherein said head has a front end;

wherein said had has a rear end;

wherein said casing has a front end;

wherein said casing has a rear end;

wherein said front end of said casing is removably attached to said rear end of said head by mating portions of hook and loop fasteners; and wherein said mating portions of hook and loop fasteners allow said casing and said head to be independent of each other prior to use.

2. The firearm as defined in claim 1, wherein said barrel extends from said handle.

3. The firearm as defined in claim 1, wherein said firing apparatus is operatively connected to said barrel.

4. The firearm as defined in claim 1, wherein said handle is shaped for fitting in the hand of a user.

5. The firearm as defined in claim 1, wherein said barrel is hollow so as to be able to contain said cartridge; and wherein said barrel extends forwardly from said handle.

6. The firearm as defined in claim 1, wherein said firing apparatus comprises a trigger; and wherein said firing apparatus comprises a firing pin.

7. The firearm as defined in claim 6, wherein said trigger of said firing apparatus depends from where said barrel meets said handle for being readily accessible by the trigger finger of the hand of the user when the hand of the user grips said handle.

8. The firearm as defined in claim 6, wherein said firing pin of said firing apparatus is operatively connected to said trigger of said firing apparatus; and wherein said firing pin of said firing apparatus is contained in said barrel so as to engage said cartridge when said trigger of said firing apparatus is squeezed.

9. The firearm as defined in claim 1, wherein said casing extends colinearly rearwardly from said head.

10. The firearm as defined in claim 1, wherein said head contains said pressurized fire extinguishant; and wherein said casing contains a propellent.

11. The firearm as defined in claim 1, wherein said head is slender;

wherein said head is elongated; and wherein said head is generally cylindrically-shaped.

12. The firearm as defined in claim 1, wherein said front end of said head is generally hemispherically-shaped; and wherein said rear end of said head is generally flat.

13. The firearm as defined in claim 1, wherein said casing is slender; and wherein said casing is generally cylindrically-shaped.

14. The firearm as defined in claim 1, wherein said front end of said casing is generally flat; and wherein said rear end of said casing is generally flat.

15. The firearm as defined in claim 1, wherein said rear end of said casing has a primer cap thereon.

16. The firearm as defined in claim 1, wherein said head has a lip.

17. The firearm as defined in claim 16, wherein said lip of said head extends forwardly from said front end of said head.

18. The firearm as defined in claim 1, wherein said lip of said head contains a chamber.

19. The firearm as defined in claim 18, wherein said chamber in said lip of said head is generally T-shaped.

20. The firearm as defined in claim 18, wherein said chamber in said lip of said head has a longitudinal portion; and wherein said chamber in said lip of said head has a transverse portion.

21. The firearm as defined in claim 20, wherein said longitudinal portion of said chamber in said lip of said head communicates with said pressurized fire extinguishant in said head.

22. The firearm as defined in claim 21, wherein said transverse portion of said chamber in said lip of said head communicates with said longitudinal portion of said chamber in said lip of said head; and wherein said transverse portion of said chamber exits said lip of said head through through bores in both sides of said lip of said head, respectively.

23. The firearm as defined in claim 22, wherein said head comprises a release pin; and wherein said release pin is removed and said firing apparatus is activated causing said cartridge to exit said barrel and expel said pressurized fire extinguishant on its way to the fire during use.

24. The firearm as defined in claim 23, wherein said release pin extends releasably through said through bores in said lip of said head and releasably through said transverse portion of said chamber in said lip of said head to prevent said pressurized fire extinguishant from escaping therefrom prior to use.

25. The firearm as defined in claim 23, wherein said through slot in said one side wall of said muzzle end of said barrel provides clearance for said release pin when said cartridge is loaded into said barrel through said muzzle end of said barrel.

26. The firearm as defined in claim 23, wherein said head comprises a pair of O-rings.

27. The firearm as defined in claim 26, wherein said pair of O-rings are disposed in said through bores in said lip of said head, respectively, and provide a seal for said release pin.

* * * * *